United States Patent [19]

Raudat

[11] 4,432,189

[45] Feb. 21, 1984

[54] SHIFTING GRID STYLE PACKER WITH LANE HOLDBACK

[75] Inventor: John L. Raudat, North Madison, Conn.

[73] Assignee: Standard-Knapp, Inc., Portland, Conn.

[21] Appl. No.: 269,389

[22] Filed: Jun. 1, 1981

[51] Int. Cl.[3] ..... B65B 21/06; B65B 21/16

[52] U.S. Cl. ..... 53/497; 53/248

[58] Field of Search ..... 53/247, 543, 497, 248, 53/260, 255

[56] References Cited

U.S. PATENT DOCUMENTS

| | | | |
|---|---|---|---|
| 3,052,071 | 9/1962 | Copping | 53/497 |
| 3,325,967 | 1/1967 | Wild | 53/248 X |
| 3,561,189 | 2/1971 | Raudat | 53/248 X |
| 3,570,216 | 3/1971 | Frentzel | 53/497 X |
| 4,078,361 | 3/1978 | Hartness et al. | 53/248 X |
| 4,169,342 | 10/1979 | Hartness et al. | 53/248 |
| 4,175,364 | 11/1979 | Becker et al. | 53/248 X |
| 4,231,213 | 11/1980 | Okazaki | 53/497 |

*Primary Examiner*—James F. Coan

*Attorney, Agent, or Firm*—McCormick, Paulding & Huber

[57] ABSTRACT

A case packer has a grid with fixed lane guides to receive columns of articles in an array which can be isolated from articles on the infeed conveyor by upright posts on a shifting plate. The articles to be dropped are supported on a shifting grid which moves with the shifting plate up to a predetermined point where the plate and posts stop and the grid moves further and in a downstream direction to separate the articles being dropped from those held back by the posts.

10 Claims, 6 Drawing Figures

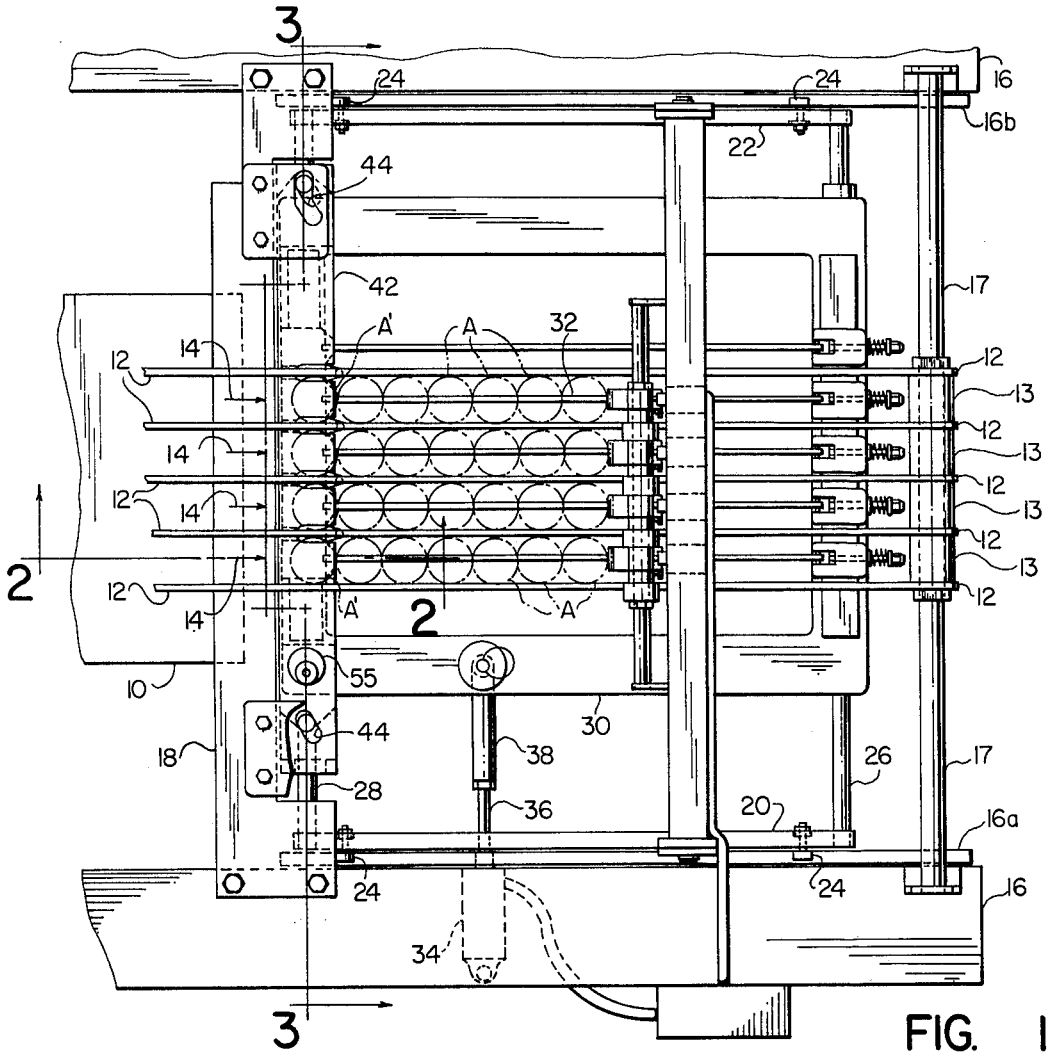
FIG. 1
FIG. 2
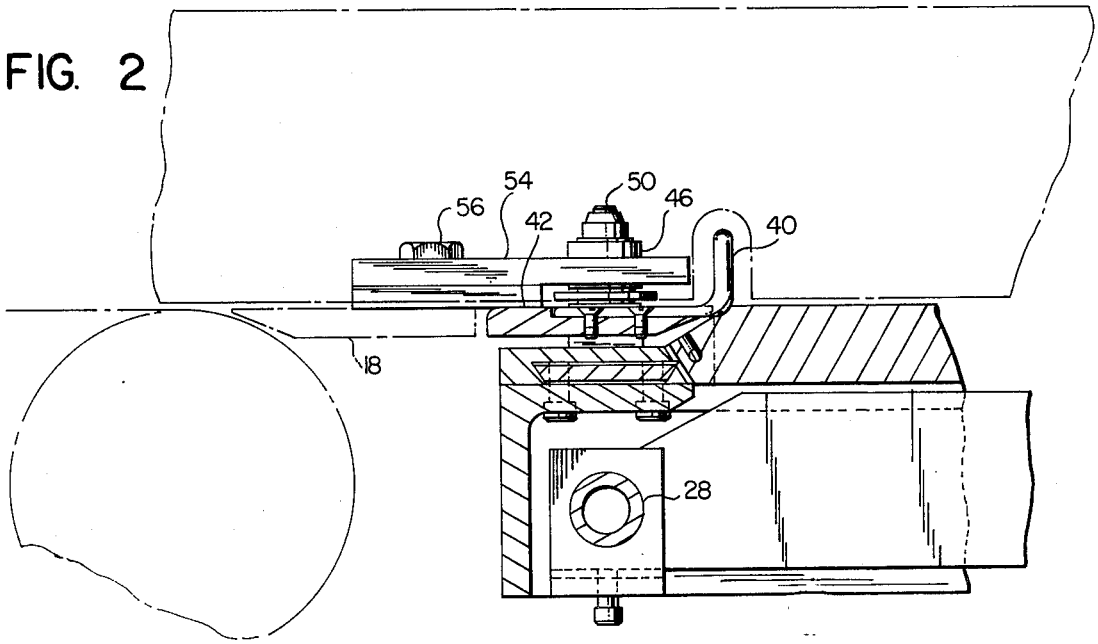

SHIFTING GRID STYLE PACKER WITH LANE HOLDBACK

This invention relates generally to packers of the type having a shifting grid such that slugs of articles are received in the upper portion of the grid for gravity feed into an upwardly open packing case, and deals more particularly with a shifting grid which includes means for holding back the articles in lanes on an infeed conveyor associated with such a packer to obviate the need for line brakes or the like.

U.S. Pat. No. 3,561,189 entitled "Shifting Grid" illustrates a typical mechanism for receiving rows of bottles and controlling the gravity fall of each charge or slug dropped into an upwardly open case. Detecting means is provided for controlling the operation of the shifting grid and selectively operated line brakes are generally provided in association with the downstream end of an infeed conveyor so that the line pressure of articles on the infeed conveyor is held back during the shifting movement of the grid riding strips to permit the articles to be dropped into the case. Another prior art U.S. Pat. No. 3,325,967 illustrates a shifting grid wherein the necessity for line brakes has been eliminated by providing pins which move with the shifting grid to hold back the articles during free fall of the charge into the upwardly open case. However, it has been found advantageous to not only shift the grid, and its riding strips along which the articles are fed for such free fall, but it has also been found advantageous to move the shifting grid downstream slightly in order to relieve line pressure between the articles in the grid and those on the infeed conveyor so that the endmost article held back by such pins or such a line brake do not interfere with the free fall of the articles held in the grid. The present invention provides not only for a shifting grid, wherein riding strips are shifted laterally, but also provides for moving the grid downstream slightly in order to provide this clearance between the articles in the grid and those held back in the lanes of articles on the infeed conveyor. This is accomplished by including pin means for holding back the articles on the infeed conveyor, such that these articles are not allowed to drift downstream and to thereby interfere with the free fall of the articles in the grid by reason of the shifting grid. The present invention not only provides for this lateral shifting of the pin means but also provides for movement of the grid downstream in order to provide clearance between the articles being dropped and those held back on the infeed conveyor. Prior art Pat. No. 3,325,967 does not provide both these features in a single shifting grid packer.

BRIEF DESCRIPTION OF THE DRAWINGS

FIG. 1 is a top plan view of a shifting grid style packer incorporating the present invention.

FIG. 2 is a vertical sectional view taken generally on the line 2—2 of FIG. 1.

DETAILED DESCRIPTION

Turning now to the drawings in greater detail, FIG. 1 shows a continuously operated infeed conveyor 10, the downstream end of which infeed conveyor 10 is located in closely spaced relationship to the packer to be described, such that articles of uniform shape and size are adapted to be fed downstream in the direction of the arrows 14, 14 between fixed lane guides 12, 12 supported in conventional fashion from the fixed frame 16 of the packer in accordance with conventional practice.

Figure 3:
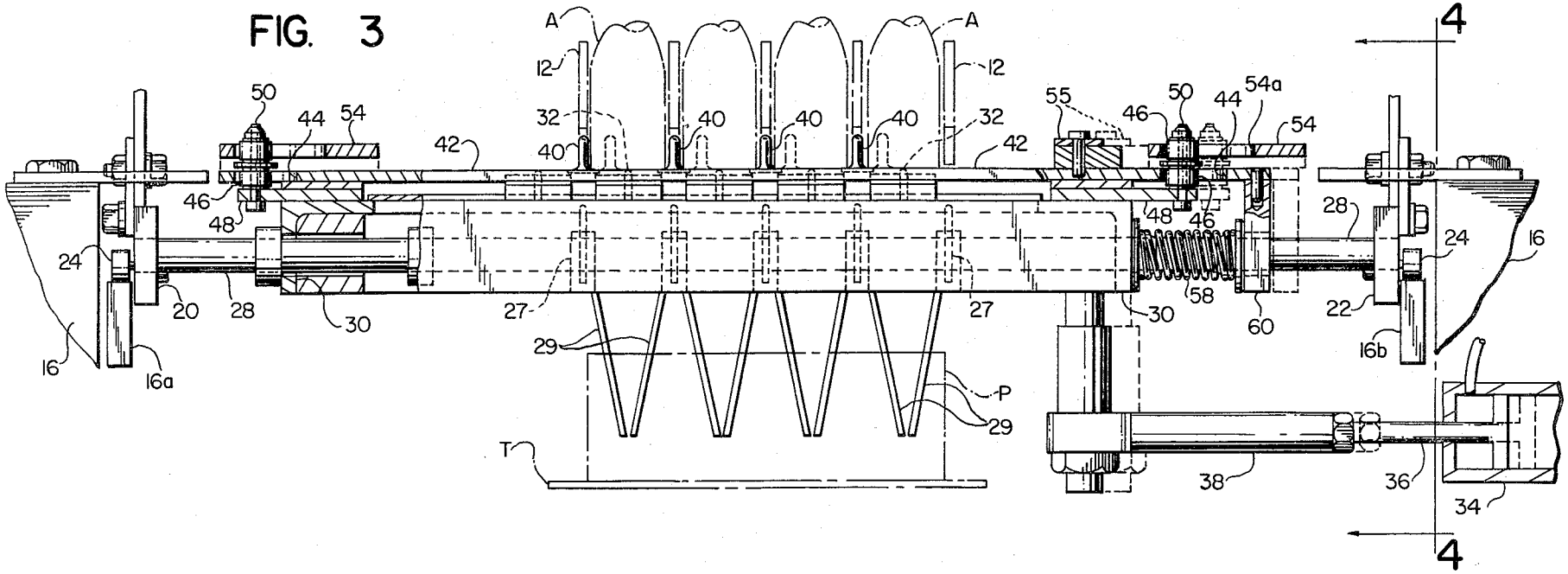
FIG. 3 is a vertical sectional view taken generally on the line 3—3 of FIG. 1.

The packer frame 16 includes parallel legs arranged in laterally spaced relationship to the longitudinal direction of motion for the articles A, A and is best shown in FIG. 3. Each frame leg 16 includes means defining ways for supporting a grid assembly, to be described, in order to allow limited longitudinal movement of the grid assembly relative to the fixed frame 16.

The grid assembly comprises longitudinally extending parallel side members, 20 and 22, each of which carries a pair of rollers 24, 24 such that the grid assembly is free to move in the longitudinal direction in a manner to be described. The grid assembly further includes cross slide defining means in the form of parallel tubular shafts, 26 and 28, which shafts have their end portions secured in the members 20 and 22 of the grid assembly. A shifting grid frame 30, including strips 32, 32 is slidably supported on these shafts and connected to the fixed frame 16 through camming means to be described.

The grid assembly, and more particularly the shafts 26 and 28, each are adapted to support depending pocket defining fingers 29, 29 as best shown in FIG. 3. The upper ends of these fingers 29 are secured in finger holder assemblies 27 on bars 25, 25 such that the articles to be packed A, A can be guided during their downward movement through pockets defined by the fingers into upwardly open cells defined for this purpose in the packing case P provided, as suggested in FIG. 3 on the lift table T. Thus, the articles A, A are supported on riding strips 32, 32 for entry into the upper portion of the grid style packer shown, and when the shifting grid frame 30 is moved toward the right, through the FIG. 5 position to the FIG. 6 position by air cylinder 34, grid frame 30 together with the associated riding strips 32, 32 will move into alignment with the lane guides 12, 12 such that the articles A, A are free to drop downwardly through the pocket defining fingers into the packing case.

Figure 5:
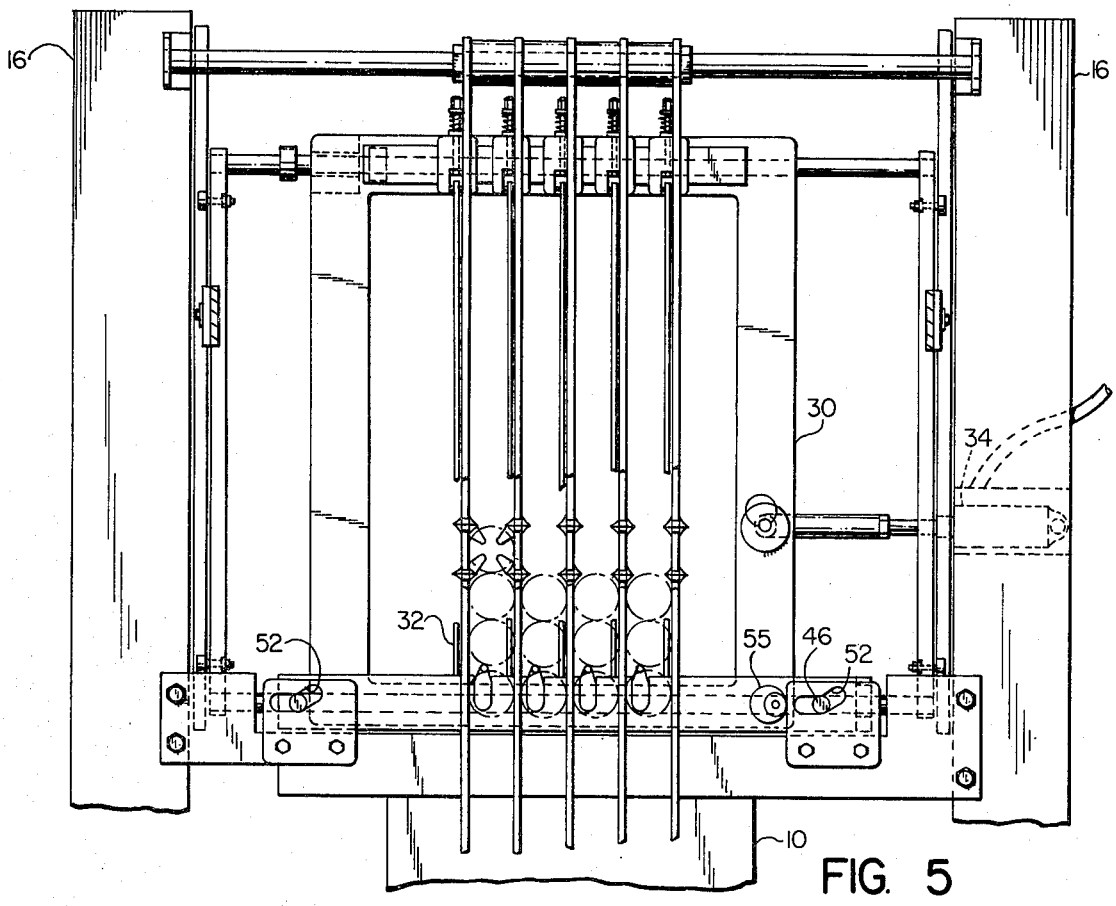
FIG. 5 is a view similar to FIG. 1 being taken at a slightly later instant of time in the cycle of operation of the packer, and with portions omitted for clarity.
Figure 6:
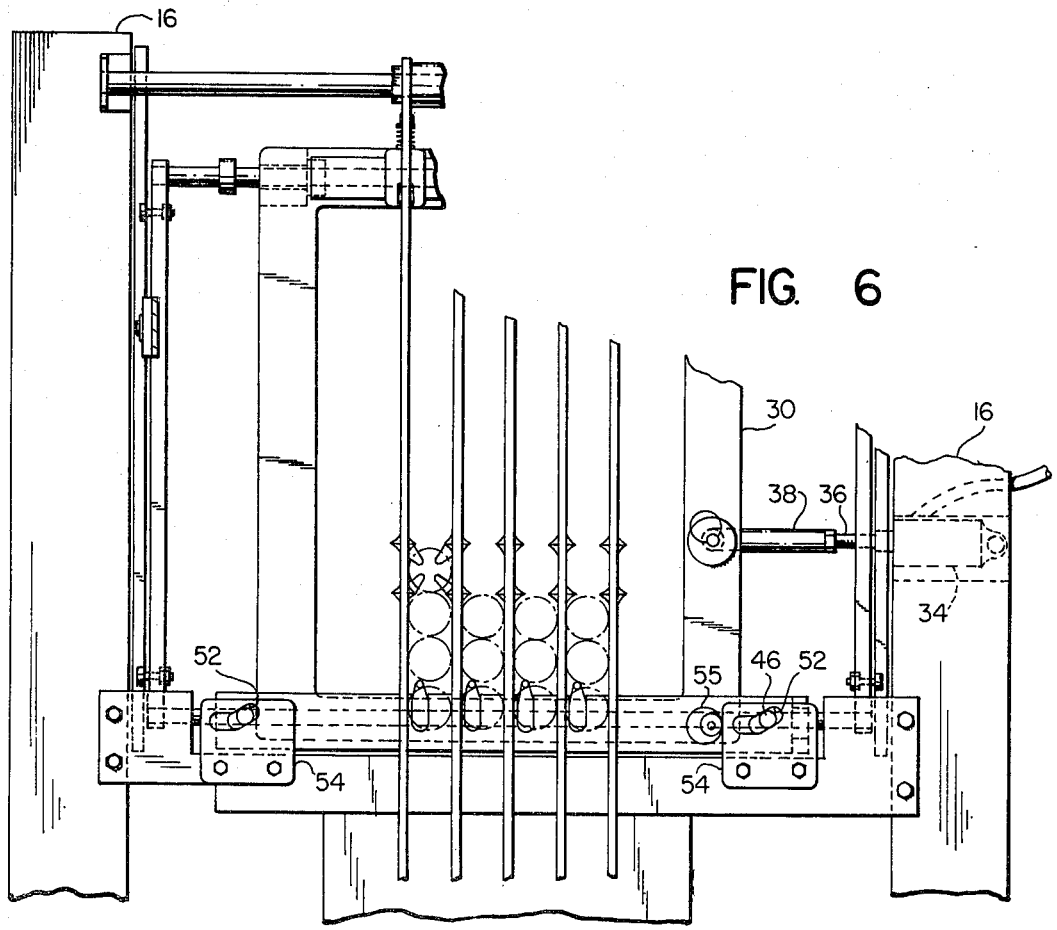
FIG. 6 is a view similar to FIGS. 1 and 5 but taken at a still later instant of time in the machine cycle, and with a portion thereof broken away.

FIG. 1 shows the air cylinder 34 together with its actuating rod 36 and connecting link 38 such that transverse movement of the grid frame 30 can be achieved for the above described gravity feed case packing operation. FIG. 5 shows the riding strips 32, 32 just prior to clearing the way for the downwardly dropped articles A, A and FIG. 6 shows the riding strips after they have been aligned with the lane guides 12, 12 in order to permit the free fall of the articles as described above. It will be recalled that these lane guides 12, 12 are supported in fixed relationship to the frame 16 of the packer. More particularly a lateraly extending support member 17 is provided at one end of the packer with its end portions mounted in the frame legs 16, 16 respectively so as to support these lane guides 12, 12. Spacers 13 are preferably provided therebetween as best shown in FIG. 1.

The shifting grid frame 30 not only moves transversely or at right angles to the longitudinal direction defined by these lane guides 12, 12 but the shifting grid frame also is adapted to move downstream slightly in the longitudinal direction in order to provide clearance between the articles being dropped and the articles to be held back on the infeed conveyor. More particularly articles A', A' on the deadplate 18 associated with the downstream end of the conveyor 10, are spaced from articles A, A in the grid as shown in FIG. 6. The row of articles to be held back on the deadplate 18 are indicated generally at A' in FIG. 1 and the abutment means for holding back these articles comprises a plurality of upstanding posts 40, 40 each of which posts comprises and L-shaped member having a horizontally extending leg secured to a horizontally extending plate 42 located downstream of, and laterally slidable with respect to, the downsteam edge of deadplate 18. This plate 42 associated with the upstanding abutment means 40, 40 is shown to best advantage in FIG. 3. As noted above this member 42 is restricted to movement parallel the fixed deadplate 18, that is at right angles or perpendicular to the longitudinal direction defined by the lane guides 12, 12. Further, this member 42 has cam slots 44, 44 which are linear, but inclined with respect to the longitudinal direction, to provide for relative transverse motion between member 42 and cam follower rollers 46, 46 provided in the grid frame 30. More particularly a member 48 is preferably provided at each side of the grid frame 30 such that it is adapted to support a cam follower roller shaft 50 in order that cam follower roller 46 can be shifted in the longitudinal downstream direction by cam slots 54, 54 provided in fixed structure associated with frame 16 in response to retraction of the air cylinder 34 as the grid frame 30 is shifted from the position shown in FIG. 1 toward the positions shown for it in FIGS. 5 and 6.

Figure 4:
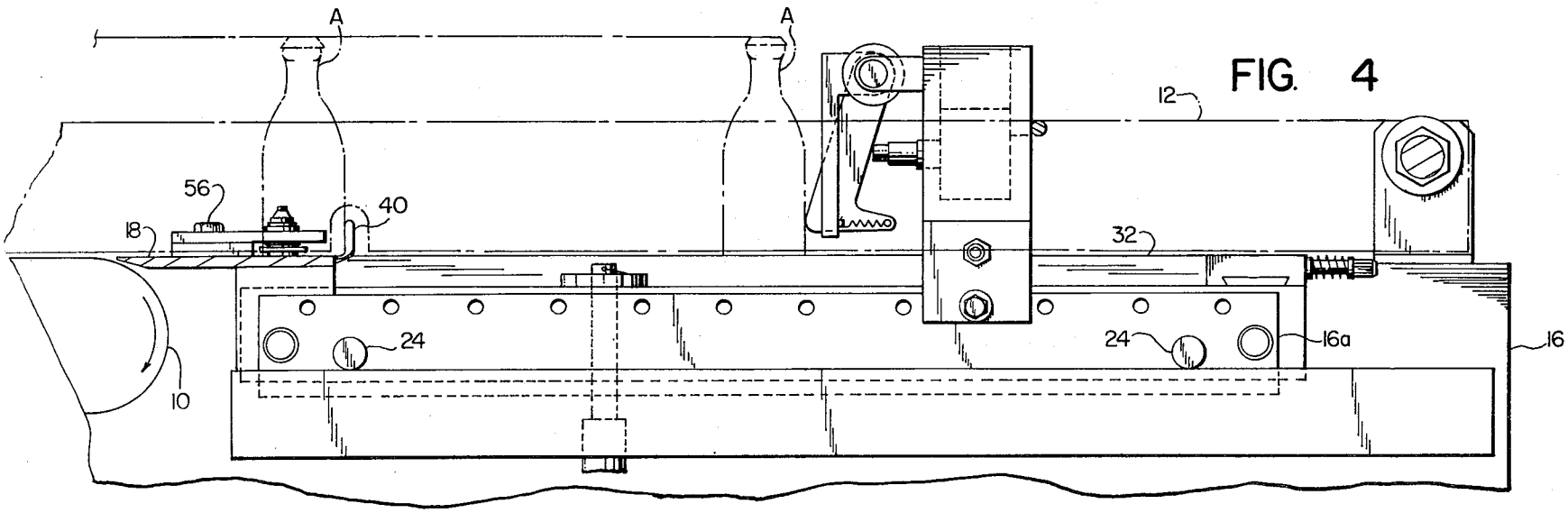
FIG. 4 is a vertical sectional view taken on the line 4—4 of FIG. 3 with portions broken away.

It is an important feature of the present invention that the above described shifting movement (associated with retraction of the air cylinder 34) will result in an initial movement of the grid frame perpendicularly to the longitudinal direction without this downstream motion and that the transverse downstream motion follows after said initial movement. More particularly, and with particular reference to FIG. 5, the shifting grid frame 30 and its cam follower rollers 46 will move initially from the FIG. 1 to the FIG. 5 position on a "one to one" basis with the member 42 described above. It is only after reaching the broken line FIG. 3 position that further movement of plate 42 is stopped by adjustable stop 55 and that the cam follower 46 will move transversely in the slot 44 associated with the abutment means supporting plate 42. As the cam follower 46 moves from the FIG. 5 position to the FIG. 6 position it will be cammed downstream by the canted portion 52 of slot 54*a* provided in fixed cam plate 54. Two such plates 54, 54 are provided in fixed relationship to the frame 16 and fixed deadplate 18. Screws 56, 56 best shown in FIG. 2 and FIG. 4 support these cam plates 54, 54. The inclined slots 44, 44 in the member 42 thus serve as a lost motion mechanism for the plate 42 such that movement of the cam followers 46, 46 from the FIG. 5 to the FIG. 6 will cause the grid frame 30 to shift downstream without causing downstream shifting movement for the member 42 and abutment means 40, 40.

By way of summary then, and with particular reference to FIG. 3, retraction of the air cylinder 34 will cause retraction, or movement toward the right, of the grid frame 30 from the solid line position shown to the broken line position indicated in that view. Spring 58 acting against the depending leg 60 associated with the right hand of member 42, and also acting against the frame 30 as shown, will cause both these members 42 and 30 to move together from the position shown in FIG. 3 to the broken line position suggested in that view. Further retraction of the cylinder 34 will cause a lost motion between the roller 46 and the plate 42 such that the upper portion of the cam follower roller will move in the L-shaped slot 54*a* provided for this purpose in the fixed plate 54 in order to achieve downstream shifting motion of the grid frame 30 and to provide the clearance between the articles A', A' being held back on the deadplate 18 (and plate 42) and the articles to be dropped as a result of shifting movement of the shifting grid frame 30 and its riding strips 32 in the manner described above.

In accordance with conventional practice lane detectors are arranged in each of the columns defined by the lane guides 12 to provide a suitable mechanism for developing a signal when the grid frame is loaded with articles as suggested in FIG. 1. This signal will cause shifting of the grid frame and operation of the holdback pins 40, 40 as described above. Once the charge or slug of articles A, A has been released for free fall into the waiting case P a suitable time delay will signal return movement of the piston 34 and release of the abutment means will be automatically achieved without necessity for separate timing as has been the case with prior art systems such as is common with conventional line brake means operating to secure a row of articles between vertically reciprocable line brakes and a deadplate such as that indicated at 18 in the drawings. In operation, the above described improvement achieves a greater degree of reliability than has been the case with prior art case packers generally by reason of the elimination of solenoid operated line brakes, and also by reason of the elimination of the necessity for an electical signal to operate such line brakes. This is achieved in an improved packer which nevertheless provides for separation of the articles being dropped from those being held back. The pins 40, 40 provide an improved article retention device, and the novel camming device described also provides for the desirable downstream movement of the articles to be dropped.

I claim:

1. In a shifting grid style packer of the type wherein columns of articles are received from an infeed conveyor between side-by-side longitudinally extending lane guides to be formed into discrete charges for deposit downwardly into upwardly open packing cases, the improvement comprising a fixed frame having longitudinally extending ways oriented parallel to the longitudinally extending lane guides, a grid assembly movable mounted on said ways and itself defining cross slide means oriented transversely to said ways, a shifting grid frame on said cross slide means and having riding strips to support the articles when said grid frame is in one limit position and to allow the articles to drop downwardly in another grid frame limit position, means for shifting said grid frame transversely between said limit positions, article abutment means associated with each column of articles between said lane guides and movable from and to positions wherein said abutment means are aligned with certain of said lane guides, means for causing initial transverse grid frame movement from said one position to achieve corresponding movement of said abutment means as the latter move initially from said lane guide aligned positions, camming means for said grid frame to cause said grid assembly to move downstream in the longitudinal direction in response to further transverse movement of said grid frame toward said another grid frame limit position and means for preventing further movement of said abutment means in response to said further movement of said grid frame toward said another grid frame limit position.

2. The combination called for in claim 1 further characterized by fixed deadplate means adjacent the downstream end of said infeed conveyor, and plate means supporting said abutment means and located adjacent to said deadplate means, said plate means so mounted that it is restricted to slidable motion perpendicular to said longitudinal direction and being connected to said grid frame means by a lost motion mechanism such that no longitudinal motion of said grid frame is transmitted to that of said plate means and such that the grid frame is free to move transversely beyond a predetermined point without effecting corresponding transverse motion of said plate means.

3. The combination called for in claim 2 wherein said camming means comprises means defining at least one cam slot in fixed relationship to said frame, and a cam follower carried by said grid frame and located in said cam slot, said plate means also defining a cam slot of contour corresponding to only a portion of said fixed cam slot to achieve said lost motion of said plate means in said longitudinal direction, and a second cam follower carried by said grid frame and located in said last mentioned cam slot.

4. The combination called for in claim 3 wherein said fixed cam slot has a generally L-shape, one leg of the L being oriented in a direction perpendicular to said longitudinal direction, and the other leg of said L-shaped fixed cam slot oriented in a direction to define said transverse direction, which transverse direction is angularly related to said perpendicular direction.

5. The combination called for in claim 4 wherein said cam slot in said plate means is oriented to correspond to the orientation of said transverse leg of said L-shaped cam slot.

6. In shifting grid style packer of the type wherein columns of articles are received from an infeed conveyor between side-by-side lane guides to be formed into discrete charges for deposit downwardly into upwardly open packing cases, the improvement comprising a fixed frame having longitudinally extending ways oriented parallel to the longitudinal direction, a grid assembly movably mounted on said ways and itself defining cross slide means oriented transversely to said ways, a shifting grid frame on sid cross slide means and having riding strips to support the articles in one grid frame limit position and to allow the articles to drop downwardly in another grid frame limit position, means for shifting said grid frame transversely between said limit positions, a plurality of article abutment means associated with each column of articles between said lane guides and movable frame and to positions aligned with certain of said lane guides, camming means for said grid frame to cause said grid assembly to move downstream as said grid frame moves transversly to relieve the line pressure of the columns of articles in said shifting grid, and means for moving said abutment means in timed relationship with initial movement of said grid frame from said one position, said means for moving said abutment means including means for preventing further movement thereof as said grid frame continues toward said another grid frame limit position.

7. The combination called for in claim 6 further characterized by fixed deadplate means adjacent the downstream end of said infeed conveyor, and plate means supporting said abutment means and located adjacent to said deadplate means, said plate means restricted to slidable motion perpendicular to said longitudinal direction and connected to said grid frame means by a lost motion mechanism such that longitudinal motion of said grid frame is not transmitted to that of said plate means and such that the grid frame is free to move transversely beyond a predetermined point without effecting corresponding motion of said plate means.

8. The combination called for in claim 7 of wherein said camming means comprises at least one cam slot in fixed element such as said frame, and a cam follower carried by said grid frame and located in said cam slot, said plate means also defining a cam slot of contour corresponding to only a portion of said fixed cam slot to achieve said lost motion of said plate means in said longitudinal direction, and a second cam follower carried by said grid frame and located in said last mentioned cam slot.

9. The combination called for in claim 8 wherein said fixed cam slot has a generally L-shape, one leg of the L being oriented in a direction perpendicular to said longitudinal direction, and the other leg of said L-shaped fixed cam slot oriented in a direction to define said transverse direction, which transverse direction is angularly related to said perpendicular direction.

10. The combination called for in claim 9 wherein said cam slot in said plate means is oriented to correspond to the orientation of said transverse leg of said L-shaped cam slot.

* * * * *